US006411211B1

(12) United States Patent
Boley et al.

(10) Patent No.: US 6,411,211 B1
(45) **Date of Patent: *Jun. 25, 2002**

(54) GOLF EQUIPMENT INVENTORY DEVICE

(75) Inventors: Jeffrey V. Boley, 69 Kings Hwy. N., Westport, CT (US) 06880; Neil M. Goldman, Norton, MA (US)

(73) Assignee: Jeffrey V. Boley, Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/479,574

(22) Filed: Jan. 7, 2000

Related U.S. Application Data

(63) Continuation of application No. 08/993,396, filed on Dec. 8, 1997, now Pat. No. 6,023,225, which is a continuation-in-part of application No. 08/895,705, filed on Jul. 17, 1997, now Pat. No. 5,844,483.

(51) Int. Cl.[7] ..... G08B 13/14

(52) U.S. Cl. ..... 340/568.6; 340/5.92; 340/10.1; 340/505; 340/572.1

(58) Field of Search ..... 340/568.6, 572.1, 340/551, 5.92, 505, 10.1, 10.2, 10.3, 10.42, 691.1, 691.5, 326, 331, 529, 572.4; 235/385

(56) References Cited

U.S. PATENT DOCUMENTS

| | | | | | |
|---|---|---|---|---|---|
| 5,124,699 | A | | 6/1992 | Tervoert et al. | |
| 5,204,681 | A | | 4/1993 | Greene | |
| 5,291,205 | A | | 3/1994 | Greene | |
| 5,302,954 | A | | 4/1994 | Brooks et al. | |
| 5,481,259 | A | | 1/1996 | Bane | |
| 5,565,845 | A | * | 10/1996 | Hara | 340/568.6 |
| 5,877,686 | A | * | 3/1999 | Ibey et al. | 340/571 |
| 5,952,921 | A | * | 9/1999 | Donnelly | 340/568.6 |
| 5,973,596 | A | * | 10/1999 | French et al. | 340/568.6 |
| 6,023,225 | A | * | 2/2000 | Boley et al. | 340/568.6 |
| 6,057,756 | A | * | 5/2000 | Engellenner | 340/505 |
| 6,057,762 | A | * | 5/2000 | Dusza | 340/568.6 |
| 6,118,376 | A | * | 9/2000 | Regester | 340/568.6 |

* cited by examiner

*Primary Examiner*—Thomas Mullen
(74) *Attorney, Agent, or Firm*—Oppenheimer Wolff & Donnelly LLP

(57) ABSTRACT

The device of the present invention, positionable in or on a golf bag, monitors golf club location or presence. The device includes a marker mechanism, or tag, positionable on a golf club that imparts a unique identification to the club. The device also includes a sensing mechanism or sensing system that monitors the status of the clubs, including the presence, removal and return of the golf clubs. As each club includes a unique identifier, the sensing system can track the clubs by monitoring the sensors. The device also includes a readout mechanism that cooperates with the sensing system to provide information to the golfer regarding the status of their clubs.

23 Claims, 9 Drawing Sheets

GOLF EQUIPMENT INVENTORY DEVICE

This application is a continuation of Ser. No. 08/993,396, filed Dec. 8, 1997, now U.S. Pat. No. 6,023,225, which is a continuation-in-part of Ser. No. 08/895,705, filed Jul. 17, 1997, now U.S. Pat. No. 5,844,483.

BACKGROUND OF THE INVENTION

The present invention relates to a device for monitoring a golf equipment inventory in a bag or on a golf course and to a method for keeping an inventory of golf equipment.

One common and expensive problem encountered by golfers occurs when a golfer pulls several clubs from a golf bag in order to ascertain the best club for a shot. At this time, the golfer is not certain of which club is most appropriate until the golfer has studied all of the conditions. Eventually, the golfer selects an appropriate club and drops the other clubs on the ground in order to take his stroke. After making the stroke, the golfer picks up the bag, oblivious in many instances, to the fact that one or more of his or her clubs are still positioned on the ground. The golfer's forgetfulness becomes apparent when he or she has occasion to select a club he or she has forgotten, only to find it is not in the bag. At this point, the golfer must either retrace his steps, traveling backwards through the course until finding the club, or the golfer must play the rest of the round of golf without the club.

SUMMARY OF THE INVENTION

The golf equipment inventory device of the present invention, positionable in or on a golf bag, includes a marker mechanism positionable within a grip shaft of a golf club. The marker mechanism includes in one embodiment, an identification medium unique to a particular golf club. The device further includes one or more mechanisms for sensing removal and return of the golf club from the golf bag by sensing a change in presence of the marker. Each of the mechanisms for detecting a change in the marker presence transmits a signal to a readout mechanism.

The present invention also includes a marker for identifying a golf club to a sensor. The marker includes a shaft and/or an end portion attached to the shaft. The marker is positionable in a grip of a golf club.

In one embodiment of the present invention for use on golf bags enclosing at least one tube for a golf club, the device includes a magnetic sensor affixed to a bottom end or proximally to the bottom end of each tube in the golf bag. The device also includes a mechanism for detecting a signal from the magnetic sensor.

Another embodiment of the device of the present invention includes a plurality of sensors positioned within a golf bag, on an inside or outside surface of the bag. The device also includes a magnetic media that corresponds to a particular sensor bearing coded information. The magnetic media is capable of activating a single sensor of the plurality. The device additionally includes a mechanism for receiving signals from each of the sensors of the plurality.

One other device embodiment utilizes radio frequency identification (RFID) and includes a transponder positionable on or within a golf club. The device also includes a transmitter that is capable of transmitting a radio wavelength at a frequency that activates the transponder. The device further includes a mechanism for relaying to a golfer information that the golf club to which the transponder is positioned is either present or not present in the golf club bag.

DETAILED DESCRIPTION OF PREFERRED EMBODIMENTS

Figure 1:
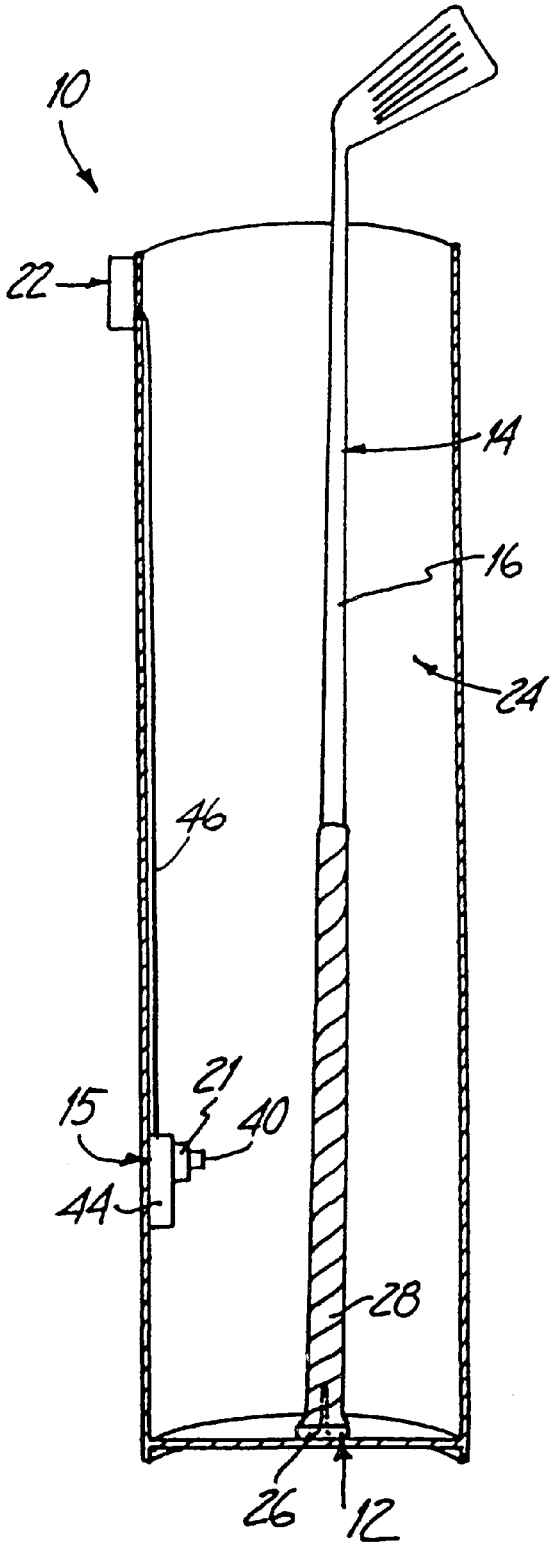
FIG. 1 is a cut-away view of one embodiment of the golf equipment inventory device of the present invention installed on a golf bag wherein the device is installed inside of a golf bag.

The golf equipment inventory device of the present invention, illustrated in one embodiment at 10 in FIG. 1 includes a marker mechanism 12 positioned within a golf club 14 wherein the marker mechanism 12 encloses or otherwise contains an identification for each club 14. The inventory device 10 further includes a sensing mechanism 15 that senses a removal of a golf club 14 from a golf bag 24 as well as return of the golf club 14 into the bag 24. The inventory device 10 additionally includes a readout 22 that receives signals from the sensing mechanism 15 and that provides information to the golfer regarding clubs that have been removed from and returned to the golf bag 24.

The inventory device 10 of the present invention permits the golfer to concentrate on the game of golf rather than concentrating on the location of his or her golf clubs. The inventory device 10 of the present invention does not require the golfer to change his or her actions regarding removal of a golf club 14 from a bag 24 or placement of the club into the bag 24. The device 10 accommodates the natural movements and behavior of the golfer in order to track the presence or absence of golf clubs 14 with respect to the golf bag 24 and to report this status to the golfer through the readout 22. Further, the device 10 may be used with any conventional golf club 14 having a shaft 16 terminating at a butt end 26 and having a grip 28.

Each golf club 14 within the golfer's inventory is fitted with the marker 12 affixed within the butt end 26 of each golf club at the grip 28. Each marker 12 encloses or otherwise contains a code readable by the sensing mechanism 15 for identifying the club's identity as well as the club's presence within or outside of the golf bag 24. The code is, in one embodiment, embodied by a magnetic strip 17 having magnetic information.

In the marker embodiment, the marker 12 includes a push shaft element 30 and an end element 32 positioned on the shaft 30 at one end of the marker 12 for concealing and protecting the marker 12 from the elements once the marker 12 has been installed in the grip 28 of the golf club 14. In one embodiment, the push shaft 30 contains the code in the magnetic media 17. In particular, magnetic media 17 is encased within the push shaft 30 that is inserted in the club grip 28. It is also contemplated that the magnetic strip 17 may be supported by the shaft 30 on the marker 12 or adhered to the shaft 30 on the marker 12 with an adhesive.

The marker 12 is preferably made of a polymeric material, such as polypropylene. However, metallic or cellulose-based materials may also be used to make the marker 12. The marker 12 may be made of a solid material or may be hollow.

Figure 5:
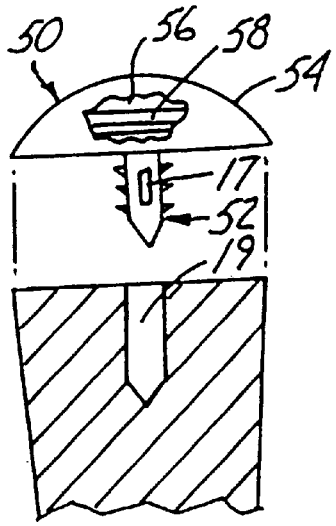
FIG. 5 is a perspective view of one other embodiment of the golf club marker mechanism of the present invention.
Figure 4:
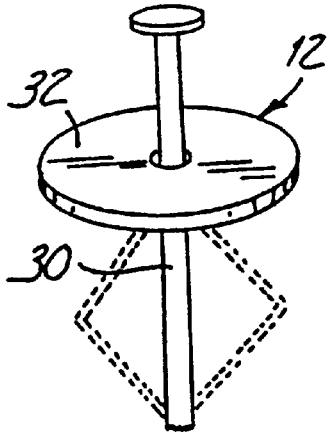
FIG. 4 is a perspective view of one embodiment of the golf club marker mechanism of the present invention.

One embodiment of the marker is illustrated at 50 in FIG. 5. The marker 50 includes a push shaft 52 and an end element 54 positioned on the push shaft 52. The marker 50 is constructed of plastic that is sufficiently reversibly deformable to fold as necessary to pass through a hole 19 in the golf club 14 but to return to its original form once in place. For the marker 50, the end element 54 encloses an orifice 56 to permit insertion of magnetic media 58 into the end element 54.

Figure 5A:
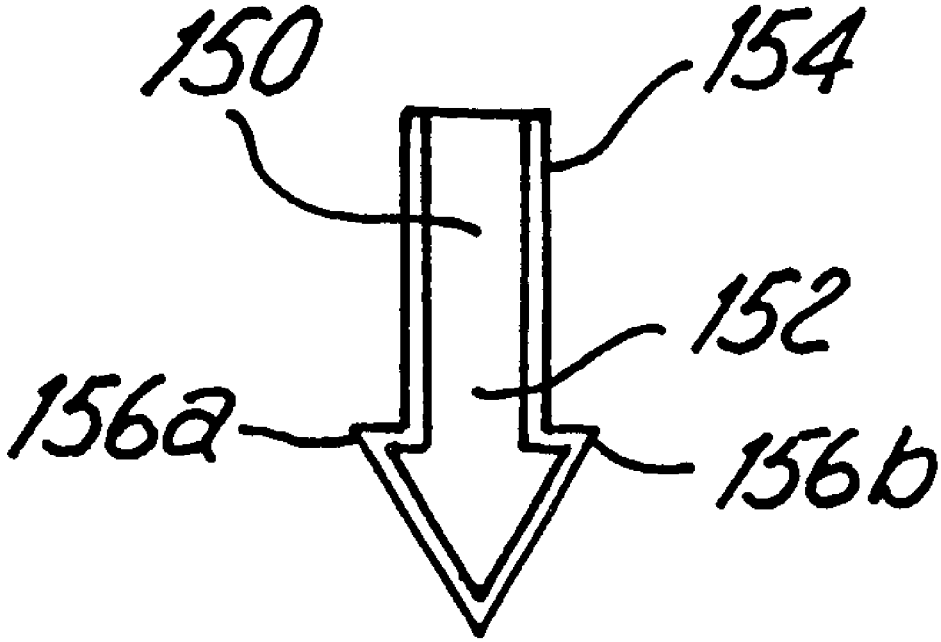
FIG. 5*a* is a side view of one other marker embodiment.
Figure 6:
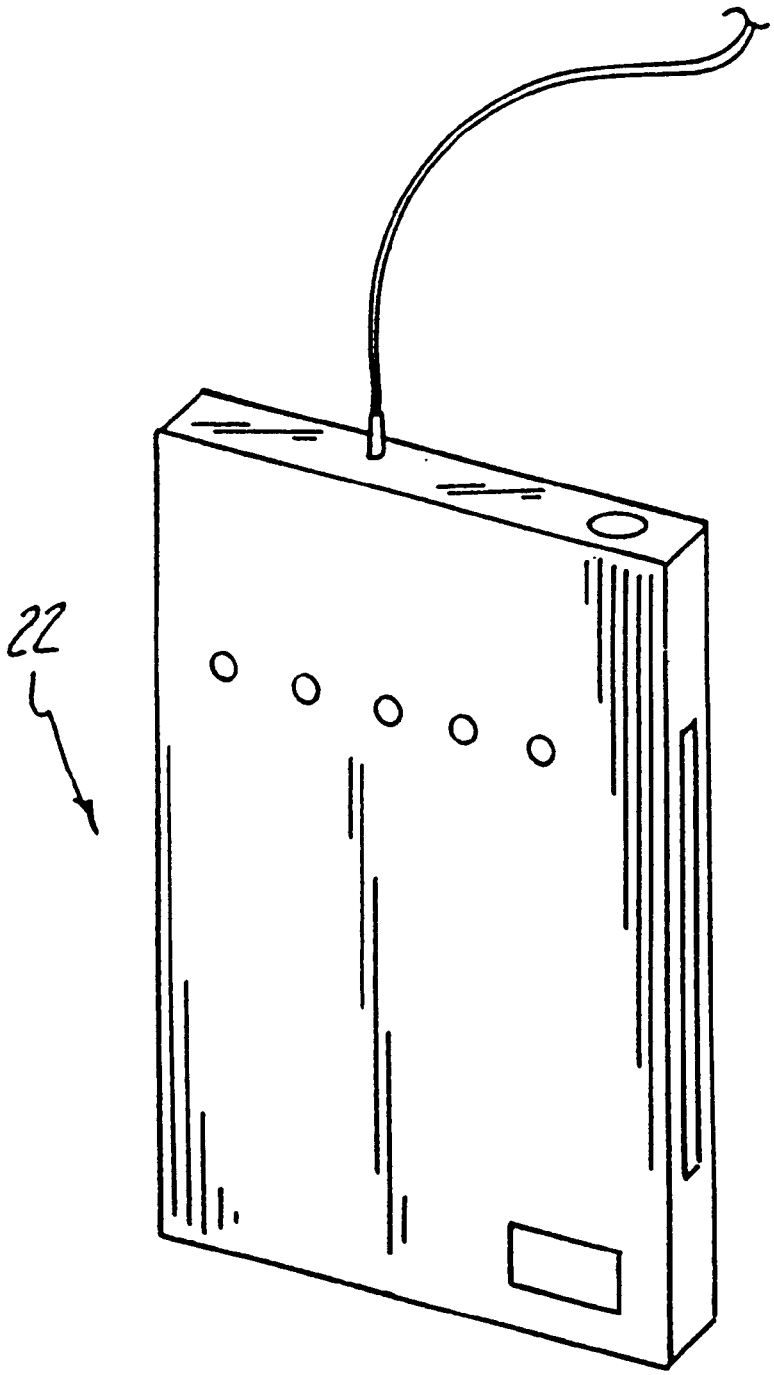
FIG. 6 is a perspective view of one embodiment of the golf club readout mechanism.

One other embodiment of the marker is illustrated at 150 in FIG. 5*a*. The marker 150 includes a main body shaft 152 overlaid with a polymeric coating 154. A plurality of teeth 156*a–b* retain the marker 150 within the grip of the golf club 14. The marker 150 may have a length of about 1 inch.

The sensing mechanism 15 includes a magnetic reader module 21 for generating read magnetic strip information signals from the unique magnetic media 17 or 58 of each marker 12 or 50 attached to each club 14. The magnetic reader module 21 includes a magnetic/charge head assembly 40 that charges and reads the magnetic information encoded on the magnetic strip 17 or 58 in each marker 12 or 50. Conventional head assemblies are known and disclosed in U.S. Pat. Nos. 5,034,836; 5,041,933; 5,274,522; and 5,285,324.

Figure 2:
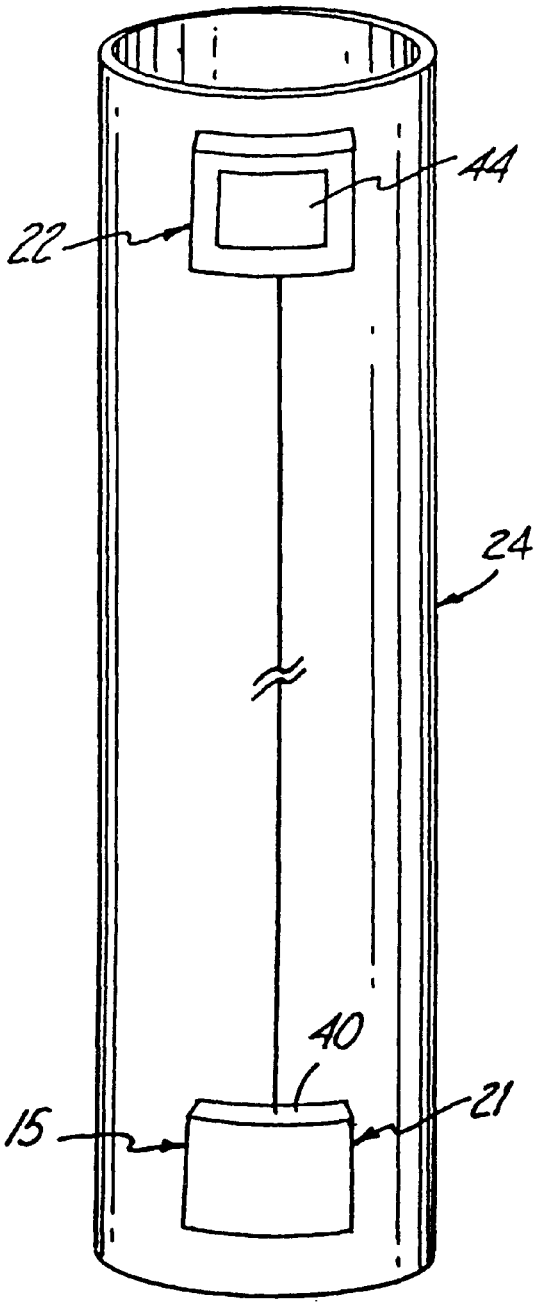
FIG. 2 is one side-view of a sensor mechanism of the golf equipment inventory device of the present invention wherein the device is installed outside of the golf bag.
Figure 3:
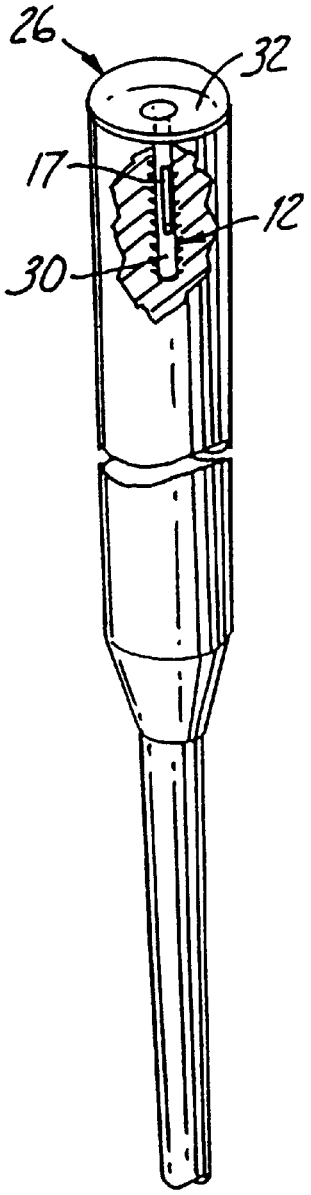
FIG. 3 is one cut-away view of a golf club marker mechanism positioned within a golf club.

The sensing mechanism 15 additionally includes, in one embodiment, a microprocessor 44 for converting the magnetic media 17 or 58 into a club identification and for storing this information. The information is then transmitted to the readout 22. In one other embodiment illustrated in FIG. 2, a microprocessor 44 is incorporated within the readout 22 only. With this embodiment, the sensing mechanism 15 transmits the raw magnetic media information code data directly to the readout 22, where it is manipulated and stored by the microprocessor.

The magnetic reader module 21 may be positioned, in one embodiment, within the golf club bag 24, as shown in FIG. 1. It is also contemplated, however, that the magnetic reader module 21 is positioned outside of the bag 24. The magnetic reader module 21 is positioned so that marker 50 is below the module 21 when stored and passes by the module 21 upon golf club removal from the bag 24. The magnetic charge head assembly 40 charges and reads the magnetic media in the golf club 14 as it passes by the mechanism 21.

The magnetic reader module 21 detects removal and return of golf clubs with respect to the bag 24. If the magnetic/charge head assembly 40 is tripped, that is, senses a golf club position, the microprocessor 44 is programmed to search for prior entry of the club into the bag due to detection of the presence of the club by detection of the marker 12. If no prior entry is found, the microprocessor 44 signals to the golfer through the readout 22 that a club 14 is missing from the bag. If a prior entry is found, the microprocessor 44 signals through the readout 22 to the player, that the club has been returned.

Figure 12:
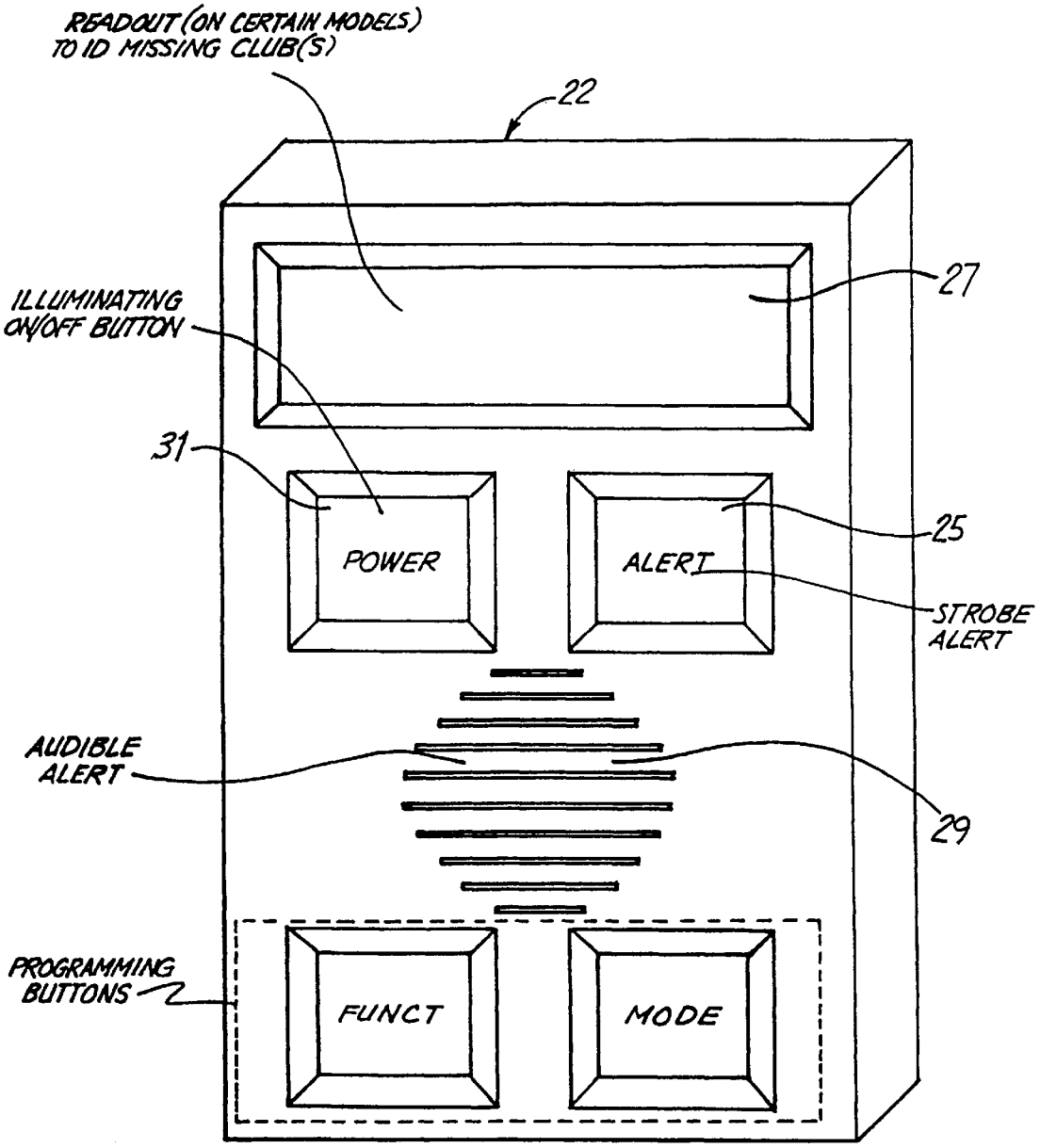
FIG. 12 is a perspective view of one readout embodiment.

The magnetic reader module 21 transmits a signal to the readout 22 illustrated in one embodiment in FIG. 12, which may be mounted on the outside of a bag 24 and is readily visible to the golfer. The readout 22 transmits a warning 25 upon golf club removal to the golfer after a time interval defined in a time delay feature is reached. The warning alert may be a strobe. In one embodiment, the time delay is five minutes. A range for time delay is ten seconds to ten minutes. The readout 22 signals to the golfer, in one embodiment, the specific club 14 which is missing from the bag 24 at 27. In another embodiment, the readout 22 emits an audible signal at 29 to the golfer indicating that a club 14 is missing. With this embodiment, the readout 22 may optionally identify the specific club. Upon replacement of the club 14 into the bag 24 and past the magnetic reader module 21, the readout 22 ceases any alerts. The readout 22 may be turned off or on at 31.

The readout typically also includes a "snooze" feature. A "snooze" feature is a time delay for alarms after a first alarm. With the "snooze" feature, the golfer may deactivate an alarm when it is initially activated. In one embodiment, after five minutes, the alarm will be reactivated.

It is contemplated that the inventory device 10 of the present invention may further include an override feature that permits a golfer to ignore the absence of a particular club. The override feature is preprogrammed into the microprocessor 44. A golfer will, in one embodiment, also have a capacity to adjust visual, such as strobe, or audio alert intervals provided by the readout 22. It is also contemplated that the inventory device may further include a remote receiver and readout 22, which is worn on the golfer's person, rather than being installed on the bag 24, in order to minimize possible distraction to other golfers. With this embodiment, the receiver and readout 22 may include a vibration mode, in addition to an audio or visual mode, to signal to the golfer that a club 14 is no longer in the bag 24. The remote readout 22 receives signals telemetrically from the sensor mechanism 15. The microprocessor 44 may be used to permit a golfer to optionally select an alert modality, i.e. an audio, visual, such as a strobe, or vibratory signal. The golfer may also select the duration of the signal, a snooze option and so on.

It is also contemplated that the inventory device of the present invention includes an option whereby the golfer may specify the number of clubs for which the inventory device will account. This feature permits golfers who carry more or fewer clubs than regulations allow to maintain an inventory of their clubs. This feature is also optionally programmed by the golfer from a selection preprogrammed into the microprocessor 44.

One other embodiment of the inventory device of the present invention is preferably meant to be customizable by each golfer and to allow for customization of golf club identification. This customization may be accomplished by an additional device which specifically encrypts or formulates a specific magnetic signal for each golfer. With this embodiment, golf clubs are encoded not only on a club basis but on a golfer identity basis as well.

In one embodiment, the magnetic reader module 21 is affixed within the bag 24. The magnetic reader module 21 is stationary and communicates with the readout 22 via a wire 46. The magnetic reader module 21 and microprocessor 44 are capable of determining whether a single club or multiple clubs have been removed from the bag 24. The magnetic reader module 21 and microprocessor 44 can also determine if one or more clubs removed from the bag has not been returned because of the data stored by the microprocessor 44.

Presented below are examples of the inventory device of the present invention. These examples are not intended to limit the device, but are presented to illustrate specific embodiments of the device.

EXAMPLE 1

Figure 7:
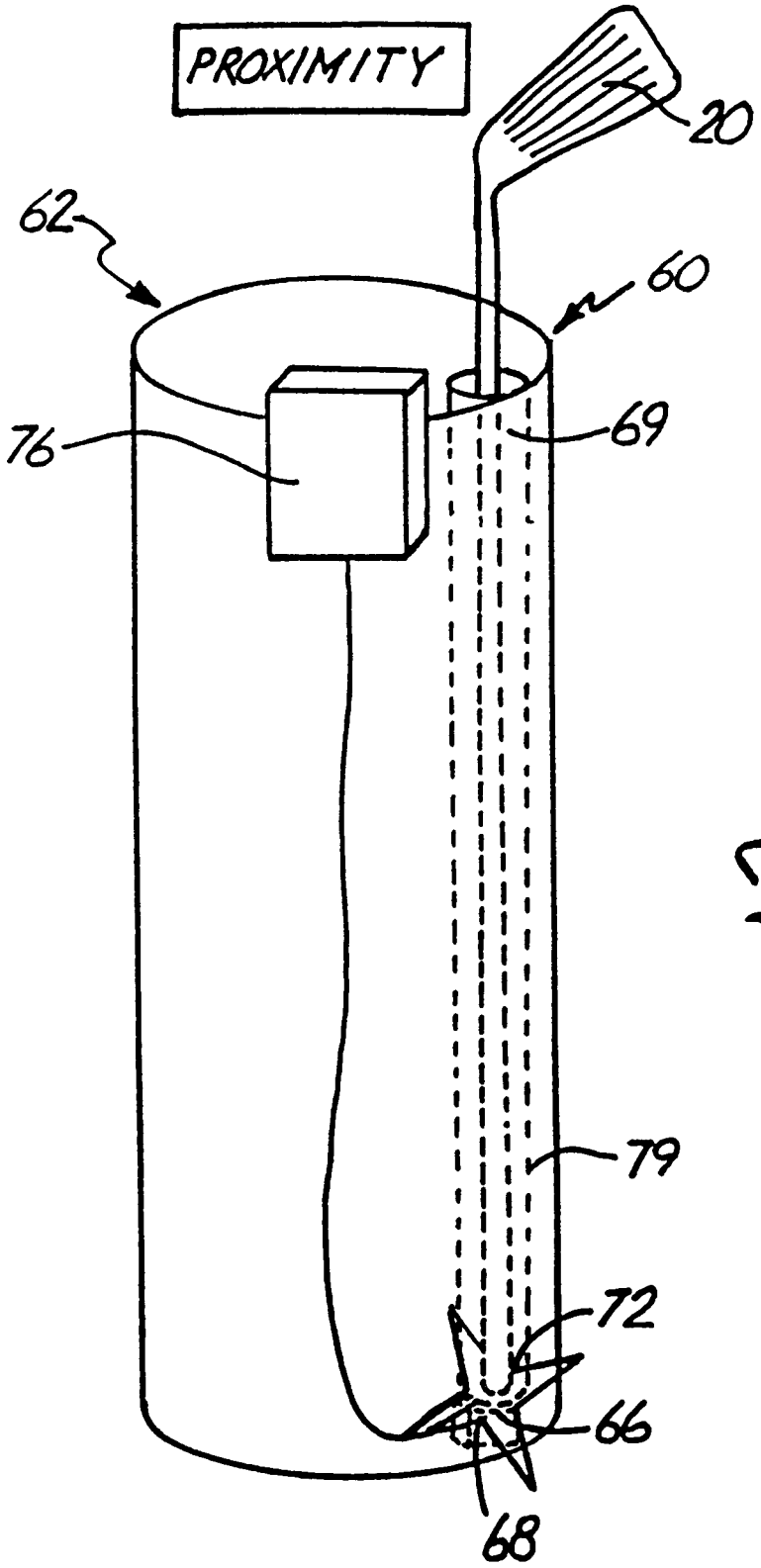
FIG. 7 is a perspective view of an embodiment of the golf equipment inventory device for use on a golf bag with fixed tube inserts.

A golf equipment inventory device for use with a golf bag with fixed tube inserts is illustrated generally at 60 in FIG. 7. The device 60 is usable on a golf bag such as is shown at 62 with one or more fixed tube inserts 64 enclosed within the bag 62. A magnetic proximity sensor 66 is affixed at or near a bottom end 68 of each tube. The magnetic proximity sensor 66 may be switched to an "open" or a "closed" position in a rest state. The term "open" as used herein refers to a sensor circuit rest state as being unenergized. The term "closed" as used herein refers to the sensor circuit rest state as being energized.

Each golf club 70 inserted into the tube 64 encloses a magnet 72 which is positioned within a butt of each club grip 74. In operation, when the club 70 is placed in the tube 64 within the bag 62, the butt of the grip 74 contacts the bottom 68 of the tube 64. The magnet 72 within the grip is then in close proximity to the magnetic proximity sensor 66, and thereby causes the sensor to either open or close a sensor circuit. If the sensor rest state is open, the magnet closes the circuit and energizes the sensor. If the sensor rest state is closed, the magnet opens the circuit and de-energizes the sensor circuit.

Although one tube and sensor are described, it is understood that a plurality of tubes and proximity sensors are positioned within the bag. In one embodiment, all of the proximity sensors are wired into one continuous series circuit of the device 60. In another embodiment, the sensors are wired in a parallel circuit. Should one or more proximity sensors 66 be switched to send an alarming signal to a readout 76 because a magnet 72 is no longer in close proximity to the sensor, the readout 76 alerts a golfer via a visible, audible, or vibratory signal that one or more clubs are missing. Once the club or clubs are replaced, the circuits are returned to a rest state and the signals are discontinued.

The device 60 utilizes wires and requires data in the form of electronic signals to be transmitted from the magnetic proximity sensors to a microprocessor readout via the wire or group of wires. The device 60 signals when a club 70 is missing from the bag 62 but is not capable of providing information as to which club or clubs are missing.

EXAMPLE 2

Figure 8:
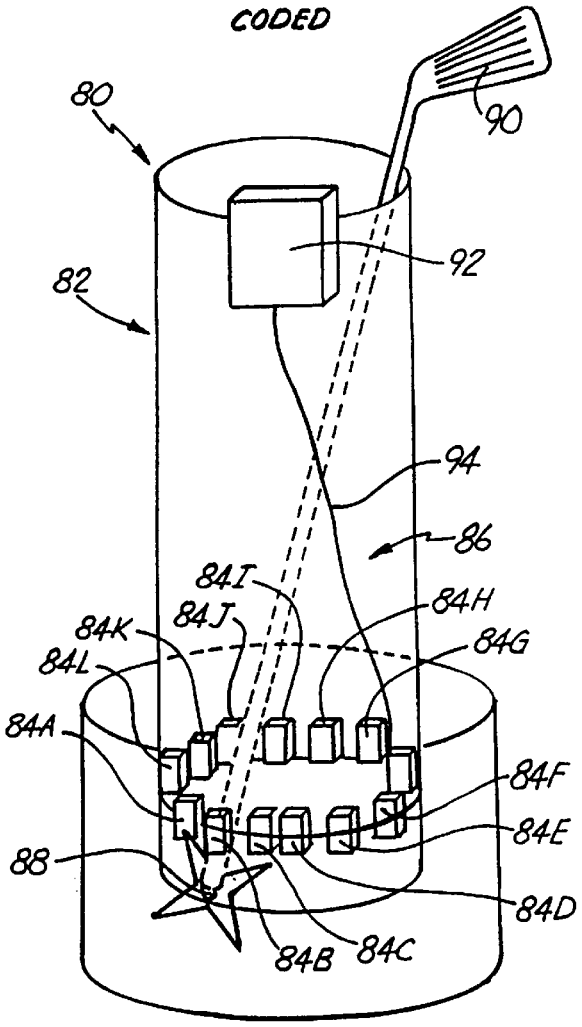
FIG. 8 is a perspective view of the golf equipment inventory device wherein the inventory device includes a coded magnetic mechanism.
Figure 8A:
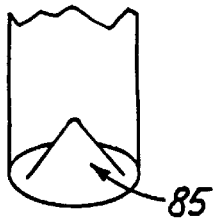
FIG. 8A is a perspective view of an inverted-v-baffle positioned within a golf bag.
Figure 10:
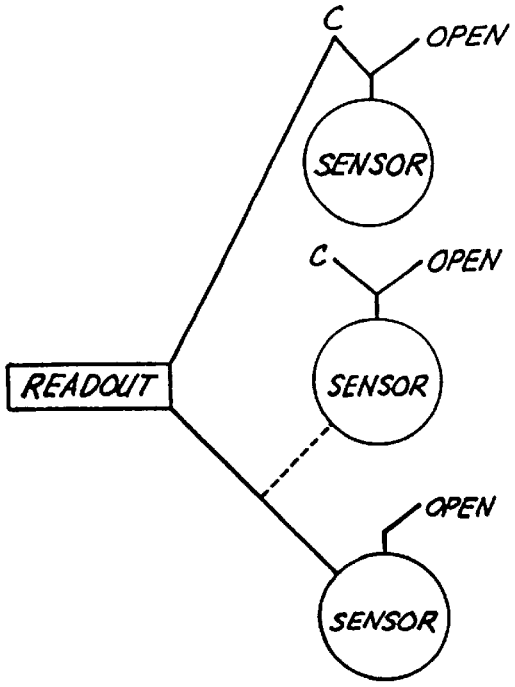
FIG. 10 is a schematic view of one control embodiment of the device of the present invention.
Figure 11:
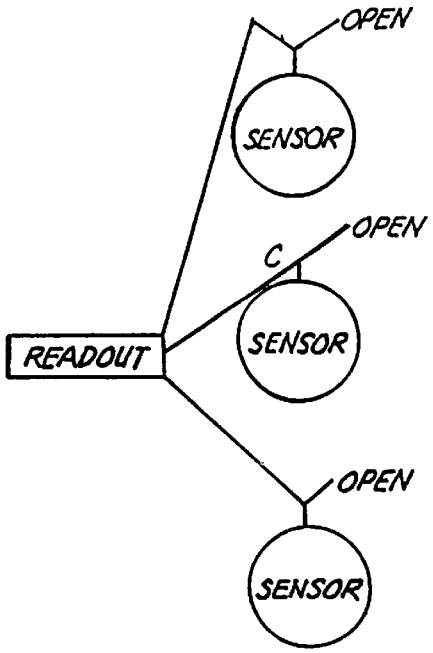
FIG. 11 is a schematic view of one other control embodiment of the device of the present invention.

One other golf equipment inventory device that can, in some embodiments, identify which particular club is missing from a golf bag is illustrated generally at 80 in FIG. 8. This device 80 is mountable on a golf bag 82 that may be an open bag or a closed bag. A plurality of sensors 84A–L is mounted on an interior surface 86 of the bag. In one embodiment, the sensors are mounted in a lower portion of the bag 82. The position of the sensors 84A–C with respect to the bottom of the bag depends upon the strength of the magnetic fields of the magnets in the grips of the golf clubs. Each of the sensors 84A–84L is activated by a corresponding magnetic field generated by a magnet that bears complementary coded information, herein called a "coded magnet." In one embodiment, an inverted conical baffle such as is illustrated at 85 in FIG. 8A is positioned on a bottom surface of the golf bag. The inverted conical baffle positions the golf clubs so that the magnets are positioned adjacent to the sensors.

The coded magnet 88 is inserted within a butt of each club 90 grip. Consequently, each club is identified by a corresponding magnetic field that can activate one or more of the sensors. Magnetic fields are selected for each coded magnet 88 so that the magnet can activate its corresponding sensor 84A–84L within the lower portion of the golf bag 82. The magnetic sensor signals are transmitted to a readout 92 by either a single wire or a group of wires such as are shown at 94.

If the sensors are wired sequentially to form a single series circuit, it will not be possible for the device to signal which specific club is missing. However, if the sensors are wired in parallel, the device may be capable of signaling which particular golf club 90 is missing from the bag 82. With this embodiment, the magnetic field of a magnet within a golf club either activates or inactivates a sensor switch resulting in either case, in a change in state of the sensor. The change in state is signaled to a microprocessor. Identification code may also be transmitted to the microprocessor. The microprocessor breaks the code and reports to the golfer through a readout which club is missing from the bag. In one embodiment, the microprocessor has a memory that can receive change in state signals from each sensor and identification code signals from each magnet. With this embodiment, the device can report multiple missing clubs.

EXAMPLE 3

Figure 9:
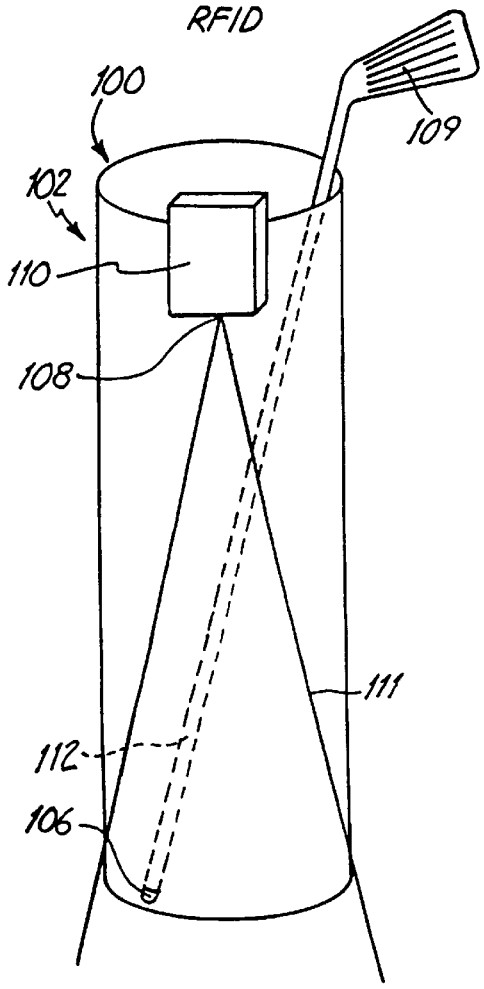
FIG. 9 is a perspective view of one embodiment of a golf equipment inventory device wherein the device includes a radio frequency identification (RFID) mechanism.

One other embodiment utilizing radio frequency identification (RFID) of the inventory device of the present invention is illustrated generally at 100 in FIG. 9. This device 100 is also positionable on an open or closed golf club bag such as is shown at 102 in FIG. 9. Each golf club 104 encloses a transponder 106 within a butt of each golf club grip 112. A transmitter, transceiver, or transmitter/receiver 108 may be positioned on a readout 110 or other points within or outside of the bag 102. The transmitter 108 transmits a unique radiowave at a particular frequency over a spatial range such as is shown at 111. The radiowave activates the transponder 106 that is programmed to respond to that particular frequency. It is contemplated that each of the fourteen or more golf clubs typically in the bag will have its own transponder that is activatable at a unique radio frequency. Electromagnetic energy created by each radiowave is sufficient to activate the transponder 106. Once activated, the transponder 106 signals to the transmitter 108 that it and the club are in the bag. Once receiving the signal from the transponder 106, the transmitter 108 sends another radio frequency that can actuate a different transponder 106, the transmitter 108 sends another radio frequency that can actuate a different transponder for a different club. These steps are repeated until the inventory device 100 has received a signal from all transponders in all of the clubs. The cycle is then repeated.

The particular transponder sensitivity and radiowave frequency are of a magnitude that confines tracking to the space within the bag 102 and not substantially outside of the bag.

The device 100 requires no wires between the transmitter and the transponder. Information concerning presence or absence of the transponder 106, hence the club, is transmitted via a radiowave. The device 100 may be installed on any type of golf bag or club. The device 100 may distinguish particular club status or may identify that one or more clubs are missing from the bag as well as identifying which clubs are missing, depending upon how information received by the transmitter 108 is processed.

The aforementioned description is not to be interpreted to exclude other golf equipment inventory devices advantageously employing the present invention. Other arrangements may be devised by those skilled in the art without departing from the spirit and scope of the present invention.

What is claimed is:

1. A detection system for determining the presence or absence of a plurality of golf clubs in a golf bag, comprising:

a plurality of transponders associated with the plurality of golf clubs; and an interrogation system for generating an interrogation signal adapted to interact with the plurality of transponders, such that each of the plurality of transponders will produce a distinct return signal, the interrogation system for further sensing the distinct return signal produced by each of the transponders and producing an indication of the presence or absence of the plurality of golf clubs.

2. The detection system of claim 1 wherein the interrogation system includes a transmitter for producing and transmitting the interrogation signal and a receiver for receiving the distinct return signals.

3. The detection system of claim 2 wherein the interrogation system includes a processor in communication with the transmitter and a receiver output, the processor for interpreting the distinct return signals and producing an inventory output indicative of the presence or absence of clubs in the golf bag.

4. The detection system of claim 3 wherein the interrogation system further comprises a readout coupled to the processor for producing an advisory signal to a golfer in response to an indication that one of the plurality of golf clubs is missing.

5. The detection system of claim 4 wherein the advisory signal is a visual signal.

6. The detection system of claim 4 wherein the advisory signal is an audible signal.

7. The detection system of claim 4 wherein the advisory signal is a physical vibration.

8. The detection system of claim 1 wherein the interrogation signal is a radio frequency signal of a predetermined frequency.

9. The detection system of claim 8 wherein each distinct return signal is at a second predetermined frequency with a predetermined time delay.

10. The detection system of claim 8 wherein each distinct return signal is at a predetermined return frequency.

11. The detection system of claim 10 wherein each distinct return signal further includes a predetermined time delay.

12. The detection system of claim 1 wherein the interrogation signal is a radio frequency signal which includes a plurality of frequency components.

13. The detection system of claim 12 wherein the interrogation signal includes a timed sequence of signal segments, each signal segment consisting of one of the plurality of frequency components.

14. The detection system of claim 13 wherein each of the plurality of transponders is responsive to one of the plurality of frequency components.

15. A golf club inventory system for monitoring the presence or absence of a golf club in a golf bag having a detector attached thereto, the inventory system comprising:

a transponder associated with the golf club for producing a unique identification signal in response to an interrogation signal produced by the detector;

a detection system for sensing the unique identification signal and producing an indication of the presence or absence of the golf club, the detection system including a transmitter/receiver for producing the interrogation signal and for detecting the unique identification signal, the detection system further including a processor coupled to the transmitter/receiver for interpreting the received unique identification signals and producing an output indicating the presence or absence of the golf club.

16. The detection system of claim 15 wherein the unique identification signal is an RF signal produced in response to the receipt of the interrogation signal produced by the detection system.

17. The detection system of claim 15 wherein the interrogation signal is a radio frequency signal of a predetermined frequency.

18. The detection system of claim 15 wherein the interrogation signal is a radio frequency signal which includes a plurality of frequency components, and wherein the identification signal is produced in response to one of the frequency components.

19. The detection system of claim 18 wherein the interrogation signal includes a plurality of sequential segments, each segment consisting of a timed signal of one of the plurality of frequency components.

20. The detection system of claim 18 wherein each of the plurality of transponders is responsive to one of the plurality of frequency components.

21. The detection system of claim 15 wherein each unique identification signal is at a second predetermined frequency with a predetermined time delay.

22. The detection system of claim 15 wherein each unique identification signal is at a predetermined return frequency.

23. The detection system of claim 22 wherein each unique identification signal further includes a predetermined time delay.

* * * * *